US006023244A

United States Patent [19]

Snygg et al.

[11] Patent Number: 6,023,244

[45] Date of Patent: Feb. 8, 2000

[54] MICROSTRIP ANTENNA HAVING A METAL FRAME FOR CONTROL OF AN ANTENNA LOBE

[75] Inventors: Göran Snygg, Partille; Christer Lindqvist, Lindome; Lars Torstensson, Jonsered, all of Sweden

[73] Assignee: Telefonaktiebolaget LM Ericsson, Stockholm, Sweden

[21] Appl. No.: 09/023,874

[22] Filed: Feb. 13, 1998

[30] Foreign Application Priority Data

Feb. 14, 1997 [SE] Sweden ..... 9700536

[51] Int. Cl.[7] ..... H01Q 1/38

[52] U.S. Cl. ..... 343/700 MS; 343/789; 343/797

[58] Field of Search ..... 343/700 MS, 846, 343/848, 789, 841, 797, 793; H01Q 1/38

[56] References Cited

U.S. PATENT DOCUMENTS

| | | | |
|---|---|---|---|
| 4,287,518 | 9/1981 | Ellis, Jr. | 343/700 MS |
| 4,791,423 | 12/1988 | Yokoyama et al. | 343/700 MS |
| 4,903,033 | 2/1990 | Tsao et al. | 343/700 MS |
| 5,001,493 | 3/1991 | Patin et al. | 343/700 MS |
| 5,414,427 | 5/1995 | Gunnarsson | 342/51 |
| 5,434,581 | 7/1995 | Raguenet et al. | 343/700 MS |
| 5,444,453 | 8/1995 | Lalezari | 343/700 MS |
| 5,448,252 | 9/1995 | Ali et al. | 343/700 MS |
| 5,469,181 | 11/1995 | Yarsunas | 343/815 |
| 5,608,414 | 3/1997 | Amore | 343/700 MS |
| 5,767,810 | 6/1998 | Hagiwara et al. | 343/700 MS |

FOREIGN PATENT DOCUMENTS

| | | |
|---|---|---|
| 124979 | 6/1973 | Denmark . |
| 0 730 319 | 9/1996 | European Pat. Off. . |
| 29 47 986 | 6/1981 | Germany . |
| 43 23 351 | 1/1995 | Germany . |
| 1412957 | 11/1975 | United Kingdom . |
| 2 286 926 | 8/1995 | United Kingdom . |

OTHER PUBLICATIONS

Derwent's Abstract No. 96–19108/02, Abstract of RU, 2035096, Nizhetgorod Radio Tech Res Inst., May 10, 1995.

*Primary Examiner*—Hoanganh Le

*Attorney, Agent, or Firm*—Burns, Doane, Swecker & Mathis, L.L.P.

[57] ABSTRACT

A device for and/or comprised in antennas, in particular microwave antennas such as microstrip antennas, for controlling the antenna lobe and completely or partially suppressing cross-coupling between the polarizations in dual-polarized antenna elements. A metal frame, the sides of which can be angled for a desired lobe width, is positioned around each antenna element on top of the ground plane of the antenna. The shape and positioning of the metal frame around the antenna element also control the antenna lobe. In this way, the antenna lobe can be controlled in the desired manner irrespective of the size of the ground plane of the antenna, which depends, for example, on a desired microstrip distribution network for the antenna.

24 Claims, 4 Drawing Sheets

MICROSTRIP ANTENNA HAVING A METAL FRAME FOR CONTROL OF AN ANTENNA LOBE

This application claims priority under 35 U.S.C. §§119 and/or 365 to SE 9700536-7filed in Sweden on Feb. 14, 1997; the entire content of which is hereby incorporated by reference.

BACKGROUND

The present invention relates to devices for and/or comprised in antennas, in particular microwave antennas, with which control and modification of the antenna lobe can be carried out. The invention also relates to devices for and/or comprised in antennas, in particular microwave antennas, with which coupling between the polarizations in dual-polarized radiating antenna elements can be reduced or completely avoided. This application is based on application No 9700536-7 filed in Sweden, the content of which is incorporated hereinto by reference.

The development of mobile telephony has created a need for simple and inexpensive mass production of antennas for, inter alia, base stations. Mobile telephony utilizes freqency ranges which lie within the microwave range, for which reason a type of antenna which is often used is microstrip antennas. Microstrip antennas consist of radiating antenna elements which are mounted in front of a ground plane. A base station usually uses a number of antennas in order to cover a cell. Different mobile telephony operators make use of different algorithms for cell planning, which results in a demand for antennas with, inter alia, different lobe widths. One known way of controlling the lobe width of a microstrip antenna is to modify the dimensions of the ground plane. If a large lobe width is desired, the size of the ground plane is limited. A major disadvantage of the size of the ground plane being reduced in the case of a large lobe width being desired is that this also limits the possibility of, for example, using a microstrip distribution network as a feeder network for the radiating elements, Therefore, antennas with wide lobes cannot on the whole use microstrip distribution networks as feeder networks or they can use them only to an extremely limited extent. If desired, antennas with narrow lobes can in most cases use microstrip distribution networks as feeder networks, which is advantageous as far as, inter alia, manufacturing aspects and therefore the costs of these antennas. Another major disadvantage of modifying the size of the ground plane in order to control the lobe width is that the shape and size of the antenna are influenced, that is to say that different antennas must be designed and subsequently manufactured for different desired lobe widths. Modifying the size and shape of an antenna results in a number of consequential problems such as, for example, the need for different weather protection (radomes) and modified mounting arrangements.

In order to achieve better and more reliable coverage, which is of particular importance within mobile telephony, use is made of polarization diversity. Antennas, in particular microwave antennas, advantageously use dual-polarized radiation elements as this reduces the size and production costs of the antenna compared with the use of single-polarized radiation elements. A requirement has arisen, in particular within mobile telephony, for antennas with ±45° polarization because this type of polarization has proved to have many advantages, such as more symmetrical propagation/attenuation, in relation to 0/90° polarization Unfortunately, it has proved to be difficult, in relation to 0/90° polarization antennas, to manufacture ±45° polarization antennas, and in particular microstrip antennas, with dual-polarized radiation elements which have satisfactory isolation between the polarizations, that is to say low cross-coupling.

SUMMARY

One object of the invention is to indicate a device for and/or comprised in antennas, in particular microwave antennas such as microstrip antennas, for controlling the lobe width of the antenna and if appropriate the lobe direction without having to modify the size of the ground plane of the antenna.

Another object of the invention is to indicate a device for and/or comprised in antennas, in particular microwave antennas such as microstrip antennas, which completely or partially suppresses the occurrence of cross-coupling between the polarizations in dual-polarized radiation elements.

According to the invention, the abovementioned objects are achieved by a device for and/or comprised in antennas, in particular microwave antennas such as microstrip antennas, for controlling the antenna lobe and completely or partially suppressing cross-coupling between the polarizations in dual-polarized antenna elements. A metal frame, the sides of which can be angled for a desired lobe width, is positioned around each antenna element on top of the ground plane of the antenna. The shape and positioning of the metal frame around the antenna element also control the antenna lobe. In this way, the antenna lobe can be controlled in the desired manner irrespective of the size of the ground plane of the antenna, which depends, for example, on a desired microstrip distribution network for the antenna.

According to the invention, the abovementioned objects are also achieved by means of an antenna for receiving and transmitting electromagnetic signals mainly within the microwave frequency range with an antenna lobe in a direction relative to the normal of the antenna. The antenna comprises a ground plane and at least one antenna element. The ground plane comprises a first side and a second side. The antenna element is mounted at a predefined distance from the first side of the ground plane and the antenna element is fed by feed means from the second side of the ground plane. An antenna element may be, for example, probe-fed or aperture-fed.

According to the invention, a metal frame is arranged on the first side of the ground plane around the projection of the antenna element on the first side of the ground plane in order thus to control the size and direction of the antenna lobe with the shape and positioning of the metal frame on the first side of the ground plane. The antenna element is suitably arranged in connection with the metal frame, that is to say that the metal frame may also serve as a holder for the antenna element. The metal frame suitably comprises a first and a second side. The second side of the metal frame faces the projection of the antenna element. The first and second side of the metal frame are suitably electrically interconnected at least along one edge which forms a line along the metal frame. The edge is suitably an upper edge/edge-line on the metal frame.

So as to improve the possibility of controlling the antenna lobe, a first angle may be formed at the edge between the first side of the metal frame and the normal of the first side of the ground plane through the edge. The first angle is considered positive from the normal of the first side of the ground plane through the edge and away from the antenna element. A second angle may also be formed and, that being the case, it is formed at the edge between the second side of the metal frame and the normal of the first side of the ground plane through the edge. The second angle is considered positive from the normal of the first side of the ground plane through the edge and towards the antenna element. The first angle may be positive and greater than zero in order thus to control the antenna lobe. The second angle may be positive and greater than zero in order thus to control the antenna lobe. The angles may each be modified with the other equal to zero or with both angles other than zero. In certain applications, it may be advantageous that the first angle is positive (greater than zero) and that the second angle is negative (less than zero) with an absolute value which is smaller than the first angle, in order thus to control the antenna lobe. In other applications, it may be advantageous that the second angle is positive and that the first angle is negative with an absolute value which is smaller than the second angle, in order thus to control the antenna lobe. In some cases, it may be advantageous if at least one angle changes in value at least once around the metal frame in order thus to control the antenna lobe.

The edge may suitably lie between the ground plane and a parallel plane in which the antenna element mainly lies. Alternatively, the edge lies mainly in a plane in which the antenna element lies and which is parallel to the ground plane. Alternatively, the edge lies beyond a plane in which the antenna element lies, in relation to the parallel ground plane. It is also conceivable that the distance of the edge from the ground plane along the normal of the ground plane varies around the metal frame in order thus to control the antenna lobe, which means that the edge may lie below, above or in the same plane as the antenna element (or another combination with one or more of the alternatives) around the course of the metal frame.

The metal frame may be electrically connected to or electrically isolated from the ground plane. The metal frame may mainly be centered around the projection of the antenna element on the first side of the ground plane or arranged asymmetrically around the projection of the antenna element on the first side of the ground plane depending upon the application. In an embodiment of the invention, the antenna is a microstrip antenna where the antenna element is an aperture-coupled patch which, if appropriate, is also, for example, ±45° dual-polarized. The edge line of the metal frame is parallel or at right angles to the polarization or polarizations of the antenna element. In certain applications which use square patches, it may be suitable if the edge line of the metal frame forms a square. The antenna may advantageously be an array antenna with at least two antenna elements each having its own metal frame.

The abovementioned objects are also achieved by means of an array antenna for receiving and transmitting electromagnetic signals mainly within the microwave frequency range with an antenna lobe in a direction relative to the normal of the array antenna. The array antenna comprises a ground plane and at least two microstrip antenna elements. The ground plane comprises a first side and a second side. The microstrip antenna elements are mounted at a predefined distance from (in front of/above) the first side of the ground plane and are ±45° dual-polarized aperture-coupled patches which are fed by a microstrip distribution network from the second side of the ground plane. According to the invention, a metal frame is arranged on the first side of the ground plane around the projection of each microstrip antenna element on the first side of the ground plane. The size and direction of the antenna lobe are controlled by means of the shape and positioning of the metal frame on the first side of the ground plane. The metal frame comprises a first and a second side with the second side of the metal frame facing the projection of the respective microstrip antenna element. The first and second side of the metal frame are electrically interconnected at least along one edge which forms a line along the metal frame. The edge is suitably an upper edge/edge-line on the metal frame. A first angle is formed at the edge between the first side of the metal frame and the normal of the first side of the ground plane through the edge and a second angle is formed at the edge between the second side of the metal frame and the normal of the first side of the ground plane through the edge. In certain applications, it is advantageous that at least one of the first and the second angles changes around the metal frame. The edge of the metal frame which forms a line around the metal frame may be equidistant from the microstrip antenna element along the whole liner or the metal frame is positioned asymmetrically around the projection of the microstrip antenna element in order thus to control the direction of the antenna lobe. The respective metal frames of different microstrip antenna elements are not necessarily the same.

The invention has a number of advantages compared with the prior art as far as antennas are concerned, and in particular microwave antennas such as microstrip antennas which use microstrip distribution networks as feeder networks for the radiating elements of the antenna. The radiating elements of the antenna may be, for example, slots, aperture-coupled patches or dipoles. The invention controls the lobe width (the lobe size) by varying only the inclination, the height or the position (or a combination of these) of the sides of a metal frame which is positioned around each radiating element in the antenna. The invention also controls the direction of the antenna lobe in relation to the normal of the antenna by determining the centering of the antenna element in the metal frame or by means of different height and angles on opposite sides on the metal frame. In this way, an antenna can be designed and subsequently manufactured in large series and can then, depending on demand, be customized simply with regard to, inter alia, the lobe width at a late stage of production. The invention also eliminates partially or completely cross-coupling between polarizations in dual-polarized radiation elements. This is achieved by the invention creating a mirror-symmetrical environment for each polarization direction, the result of which is that no component in the second polarization can be excited. In this way, the use of microstrip antennas with ±45° dual-polarized radiating antenna elements is made possible. According to the invention, cross-coupling is also reduced between different antenna elements in an array antenna. This means that the invention is of interest with regard to, for example, base station antennas for mobile telephone systems, which are manufactured in great quantities.

BRIEF DESCRIPTION OF THE DRAWINGS

The invention will be described in greater detail below in a non-limiting manner for the purpose of clarification, with reference to the attached figures, in which.

DETAILED DESCRIPTION

In order to illustrate the invention, a few examples of its application are to be described in the following with reference to FIGS. 1 to 6.

Figure 1:
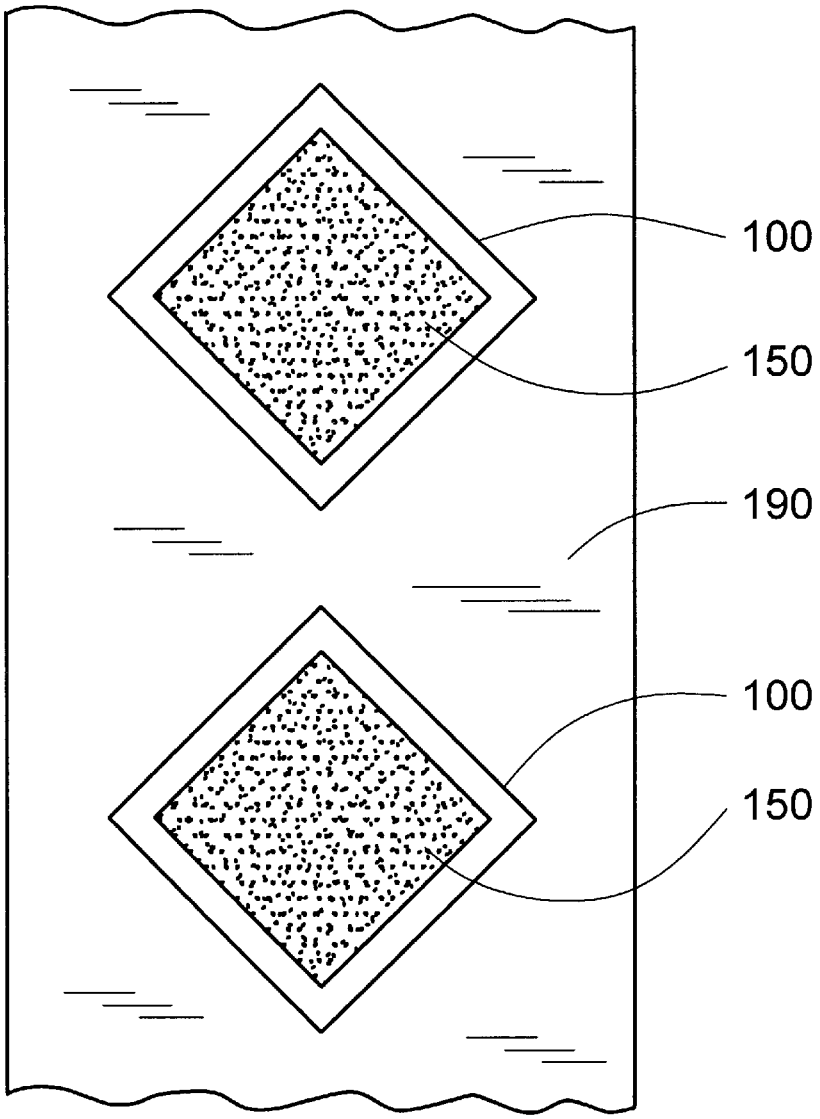
FIG. 1 shows a front view of a ±45° polarized microstrip array antenna according to the invention with aperture-coupled dual-polarized patches.

FIG. 1 shows a front view of a part of an array antenna designed according to the invention. The array antenna in the figure is a ±45° polarized microstrip antenna which may suitably be used as a base station antenna in a mobile telephone system. In this example, aperture-coupled dual-polarized patches 150 are used as radiating antenna elements. The patches 150 lie above, for example, slots in a ground plane 190. According to the invention, a metal frame 100 lies around the radiating antenna elements 150. The edge of the patch 150 lies in the order of $\lambda/20$ to $\lambda/2$ (where $\lambda$ is the wavelength) from the metal frame 100. The metal frame 100 may either be electrically connected to the ground plane 190 or electrically isolated from the ground plane 190, depending on the desired antenna characteristics.

Figure 2:
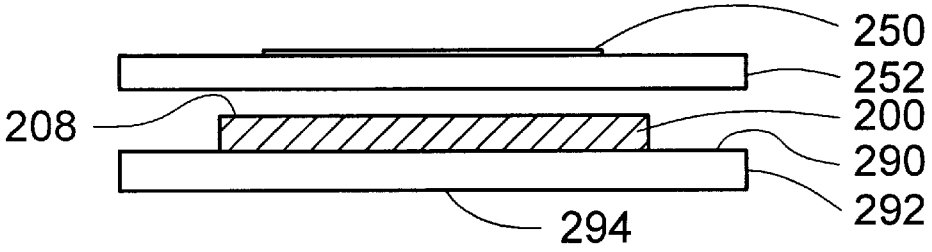
FIG. 2 shows a side view of the antenna in FIG. 1, FIGS. 3A–E show cross-sections of different embodiments of antennas according to the invention.

FIG. 2 shows a side view of a microstrip antenna according to the invention. The side view may, for example, be of an antenna similar to the antenna according to FIG. 1. Here, a microstrip distribution network is shown, comprising a distribution network 294, a ground plane 290 and a support substrate 292. The radiating antenna element 250, here shown as an aperture-coupled patch 250, usually also has a support substrate 252. A patch 250 usually lies in the order of $\lambda/10$ from the ground plane 290. According to the invention, a metal frame 200 is positioned in relation to the ground plane 290 around the projection of the respective radiating antenna element 250 on the ground plane. The upper edge 208 of the metal frame 200 is shown here in side view lying between the ground plane 290 and the patch 250. The metal frame 200 is suitably of a height of the order of $\lambda/40$ to $\lambda/4$ above the ground plane 290, which means that the upper edge 208 of the metal frame 200 will lie between the ground plane 290 and the patch 250, in the same plane as the patch 250 or on the other side, that is to say above/in front of, the patch 250.

Figure 3A:
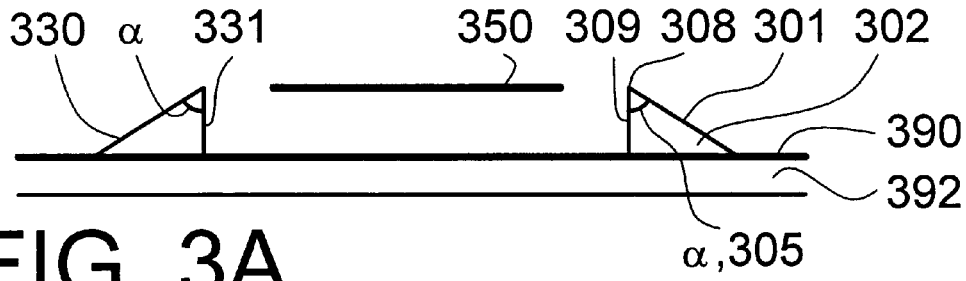

FIGS. 3A to 3E show cross-sections of different embodiments of an antenna according to the invention. The cross-sections may, for example, be of an antenna according to FIG. 1 or 2. The radiating antenna elements are here also illustrated as aperture-coupled patches 350 which are thus positioned a little way away from a ground plane 390. Only the ground planes 390 are shown with substrates 392. FIG. 3A shows a metal frame 301 with a first side 330 angled away from the radiating antenna element 350 with the angle $\alpha$ 305 between the side and the normal 309 (which in this case is the same as the second side 331 of the metal frame) of the ground plane, which normal passes through the upper edge 308 of the metal frame. The angle $\alpha$ 305 ($-90°<\alpha<180°$) is a parameter which determines the lobe width (within the range 90° to 0° the lobe is widened and from 90° upwards the lobe is compressed) and is shown as positive in FIGS. 3–6 and has been shown as 0° in FIGS. 1 and 2. The cavity 302 which arises when the angle $\alpha$ 305 is greater than zero may be air, a support substrate or any other dielectric. The metal frame 301 may also be made entirely of metal which means that the cavity 302 is filled with metal.

Figure 3B:
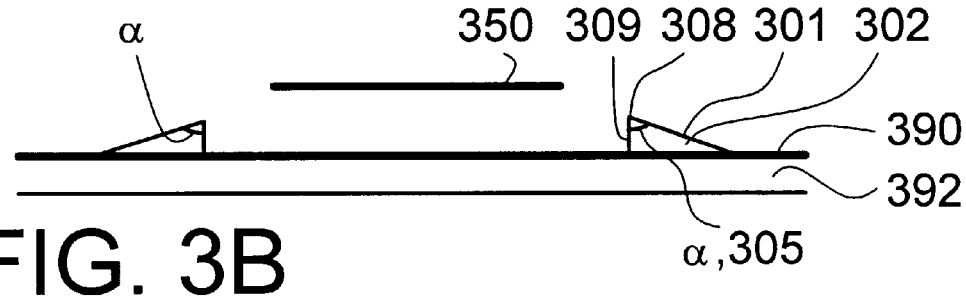
Figure 3C:
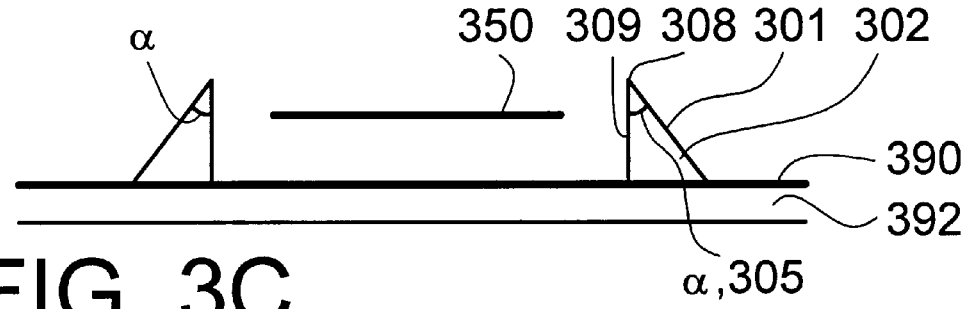
Figure 3D:
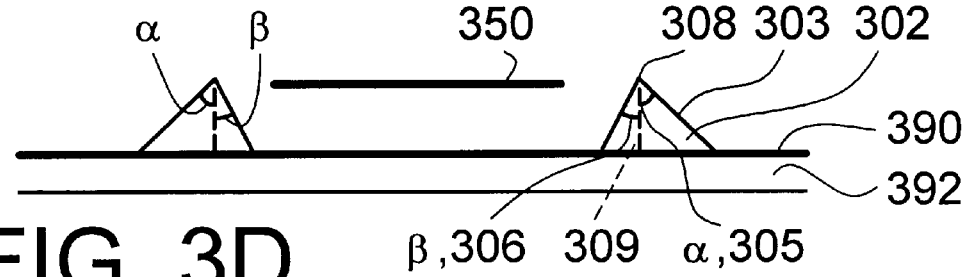
Figure 3E:
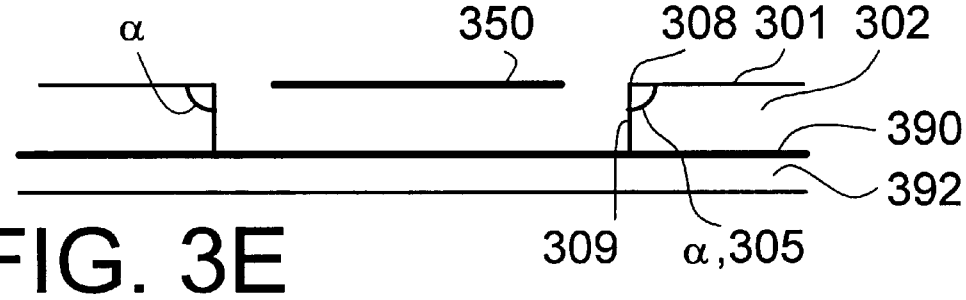

FIG. 3B shows the metal frame 301 as shorter than the distance between the ground plane 390 and the patch 350, that is to say that the upper edge 308 of the metal frame 301 lies between the ground plane 390 and a plane which is parallel to the ground plane and in which the radiating antenna element, the patch 350, mainly lies. FIG. 3C shows the metal frame 301 as taller than the distance between the ground plane 390 and the patch 350. FIGS. 3A, 3D and 3E show metal frames 301, 303 with such a height that the upper edges 308 of the metal frames 301, 303 mainly lie in the same plane as that in which the patch 350 lies. A taller metal frame gives a wider antenna lobe. The metal frame 301 may be asymmetrical in height around the metal frame 302. The antenna lobe will then be directed in the direction in which the metal frame is taller. According to the invention, the antenna lobe can also be controlled by the metal frame 301 being positioned asymmetrically around the antenna element, in this example the patch 350, that is to say that one or two sides of a square metal frame is/are closer to the antenna element than the other two or three. The antenna lobe is turned in the direction in which the antenna element is closer to the metal frame. The antenna lobe can also be controlled by modifying the circumference of the metal frame, where a smaller circumference, that is to say the metal frame is closer to the antenna element, gives a wider/larger antenna lobe.

FIG. 3D shows that an angle $\beta$ 306 ($-180°<\beta<90°$), in this case shown as greater than 0°, between that side of the metal frame towards the patch 350 and the normal 309 of the ground plane, which normal passes through the upper edge 308 of the metal frame, may also be used for controlling the lobe (it is also possible, of course, that the angle $\beta$ 306 may be negative with an absolute value which is less than the angle $\alpha$ 305).

Figure 4:
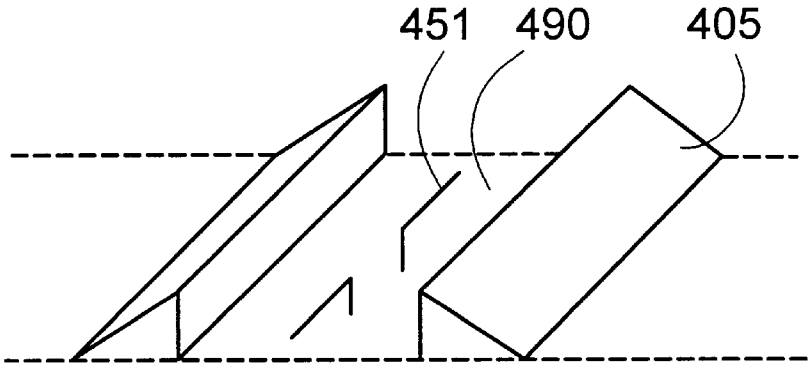
FIG. 4 shows a view of a single-polarized antenna according to the invention with a dipole as radiation element.

FIG. 4 shows an example with a single-polarized dipole 451 as an antenna element above a ground plane 490. Here, there is a requirement for only two metal walls 405 according to the invention for controlling the lobe width. Here, the metal walls 405 can be used in order to control the lobe width individually for each individual radiating antenna element 451 which, for example, forms part of an array antenna. In certain situations, it may be sufficient for a dual-polarized antenna element also to use only two metal walls.

Figure 5:
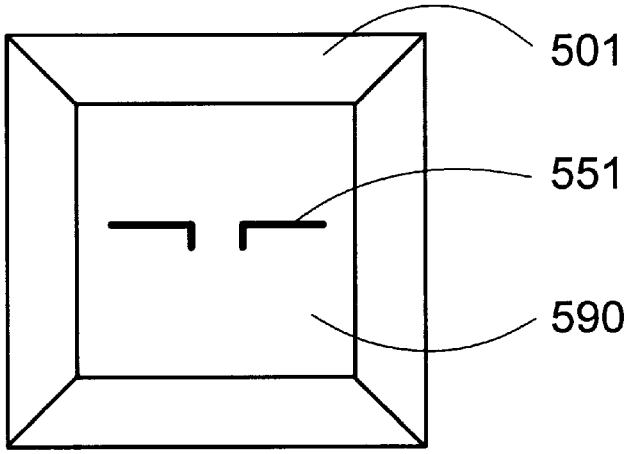
FIG. 5 shows a front view of a single-polarized antenna according to the invention with a dipole as radiation element.

FIG. 5 shows an example with a single-polarized dipole 551 above a ground plane 590, similar to the example according to FIG. 4. Here, a metal frame 501 according to the invention for controlling the antenna lobe is shown.

Figure 6A:
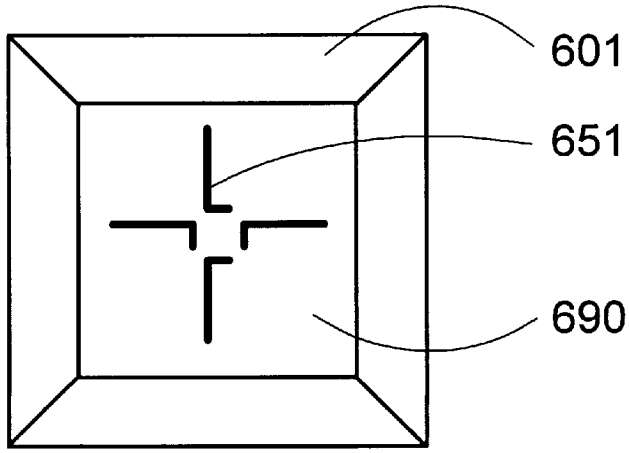
FIG. 6A–B show front views of a dual-polarized antenna according to the invention with a dipole as radiation element.
Figure 6B:
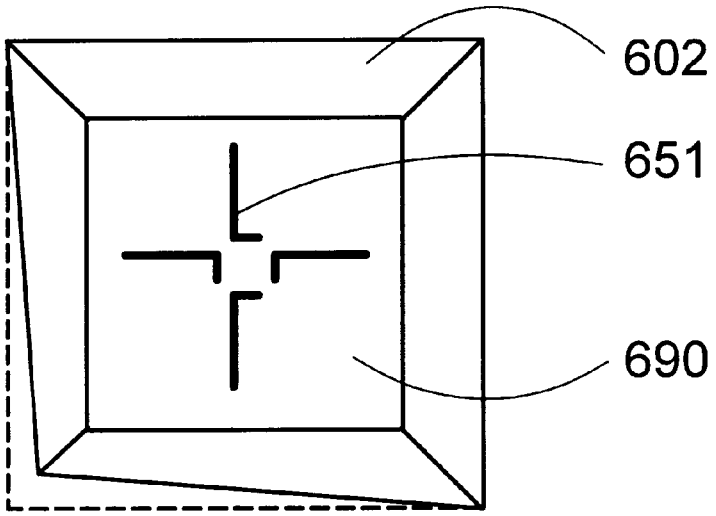

FIGS. 6A and 6B shows example with a dual-polarized dipole 651 above a ground plane 690 with a metal frame 601 and a metal frame 602, respectively according to the invention.

In FIG. 6B, an angle, formed at an edge line between the sides of the frame 602, changes around the frame 602.

The invention relates to antennas, and in particular microwave antennas such as microstrip antennas, and control of their lobes and increasing the isolation between the polarizations in the case of use of dual-polarized antenna elements. It has been shown above how a metal frame positioned on the ground plane of the antenna, around the projection of each radiating antenna element, can, by means of the positioning and shape of the metal frame, control the width and direction of the antenna lobe and also eliminate or reduce cross-coupling between the polarizations in dual-polarized antenna elements.

The invention is not limited to the embodiments indicated above but can be modified within the scope of the patent claims which follow.

What is claimed is:

1. A microstrip antenna for receiving and transmitting electromagnetic signals mainly within the microwave frequency range with an antenna lobe in a direction relative to the normal of the microstrip antenna, which microstrip antenna comprises a ground plane and at least one antenna element, the ground plane comprising a first side and a second side, the antenna element being mounted at a predefined distance from the first side of the ground plane, and the antenna element being fed be feed means from the second side of the ground plane, wherein a metal frame is arranged directly on the ground plane, on the first side of the ground plane around a projection of the antenna element on the first side of the ground plane in order thus to control the size and direction of the antenna lobe with the shape and positioning of the metal frame on the first side of the ground plane, and the metal frame comprises a first and a second side where the second side of the metal frame faces the projection of the antenna element and where the first and second sides of the metal frame are electrically interconnected at least along one edge which forms a line along the metal frame.

2. The microstrip antenna according to claim 1, wherein a first angle is formed at the edge between the first side of the metal frame and the normal of the first side of the ground plane through the edge, where the first angle is considered positive from the normal of the first side of the ground plane through the edge and away from the antenna element, and in that the first angle is greater than zero in order thus to control the antenna lobe.

3. The microstrip antenna according to claim 2, wherein at least one angle changes in value at least once around the metal frame in order thus to control the antenna lobe.

4. The microstrip antenna according to claim 1, wherein a second angle is formed at the edge between the second side of the metal frame and the normal of the first side of the ground plane through the edge, where the second angle is considered positive from the normal of the first side of the ground plane through the edge and towards the antenna element, and in that the second angle is greater than zero in order thus to control the antenna lobe.

5. The microstrip antenna according to claim 1, wherein a first angle is formed at the edge between the first side of the metal frame and the normal of the first side of the ground plane through the edge, where the first angle is considered positive from the normal of the first side of the ground plane through the edge and away from the antenna element, and in that a second angle is formed at the edge between the second side of the metal frame and the normal of the first side of the ground plane through the edge, where the second angle is considered positive from the normal of the first side of the ground plane through the edge and towards the antenna element, and in that the first angle is greater than zero and in that the second angle is negative with an absolute value which is smaller than the first angle, in order thus to control the antenna lobe.

6. The microstrip antenna according to claim 1, wherein a first angle is formed at the edge between the first side of the metal frame and the normal of the first side of the ground plane through the edge, where the first angle is considered positive from the normal of the first side of the ground plane through the edge and away from the antenna element, and in that a second angle is formed at the edge between the second side of the metal frame and the normal of the first side of the ground plane through the edge, where the second angle is considered positive from the normal of the first side of the ground plane through the edge and towards the antenna element, and in that the second angle is greater than zero and in that the first angle is negative with an absolute value which is smaller than the second angle, in order thus to control the antenna lobe.

7. The microstrip antenna according to claim 1, wherein the edge lies between the ground plane and a parallel plane in which the antenna element mainly lies.

8. The microstrip antenna according to claim 1, wherein the edge lies mainly in a plane in which the antenna element lies and which is parallel to the ground plane.

9. The microstrip antenna according to claim 1, wherein the edge lies beyond a plane in which the antenna element lies, in relation to the parallel ground plane.

10. The microstrip antenna according to claim 1, wherein the distance of the edge from the ground plane along the normal of the ground plane varies around the metal frame in order thus to control the antenna lobe.

11. The microstrip antenna according to claim 1, wherein the metal frame is electrically connected to the ground plane.

12. The microstrip antenna according to claim 1, wherein the metal frame is mainly centered around the projection of the antenna element on the first side of the ground plane.

13. The microstrip antenna according to claim 1, wherein the metal frame is arranged asymmetrically around the projection of the antenna element on the first side of the ground plane.

14. The microstrip antenna according to claim 1, wherein the antenna element is an aperture-coupled patch.

15. The microstrip antenna according to claim 1, wherein the antenna element is dual-polarized.

16. The microstrip antenna according to claim 1, wherein a edge line of the metal frame is parallel or at right angles to the polarization or polarizations of the antenna element.

17. The microstrip antenna according to claim 1, wherein a edge line of the metal frame forms a square.

18. The microstrip antenna according to claim 1, wherein the microstrip antenna is an array antenna with at least two antenna elements each having its own metal frame.

19. The microstrip antenna according to claim 1, wherein the antenna element is a ±45° dual-polarized aperture-coupled patch.

20. An array antenna for receiving and transmitting electromagnetic signals mainly within the microwave frequency range with an antenna lobe in a direction relative to the normal of the array antenna, which array antenna comprises a ground plane and at least two microstrip antenna elements, where the ground plane comprises a first side and a second side, the microstrip antenna elements are mounted at a predefined distance from the first side of the ground plane and are ±45° dual-polarized aperture-coupled patches which are fed by a microstrip distribution network from the second side of the ground plane, wherein a metal frame is arranged directly on the ground plane, on the first side of the ground plane around a projection of each microstrip antenna element on the first side of the ground plane, in order thus to control the size and direction of the antenna lobe by means of the shape and positioning of the metal frame on the first side of the ground plane, where the metal frame comprises a first and a second side with the second side of the metal frame facing the projection of the respective microstrip antenna element and where the first and second sides of the metal frame are electrically interconnected at least along one edge which forms a line along the metal frame, and where a first angle is formed at the edge between the first side of the metal frame and the normal of the first side of the ground plane through the edge and where a second angle is formed at the edge between the second side of the metal frame and the normal of the first side of the ground plane through the edge.

21. The array antenna according to claim 20, wherein at least one of the first and the second angles changes around the metal frame.

22. The array antenna according to either claim 20, wherein the edge of the metal frame which forms a line around the metal frame is equidistant from the microstrip antenna element along the whole line.

23. The array antenna according to any one of claim 20, wherein the metal frame of at least one microstrip antenna element is positioned asymmetrically around the projection of the microstrip antenna element in order thus to control the direction of the antenna lobe.

24. The array antenna according to any one of claim 23, wherein the respective metal frames of different microstrip antenna elements are not the same.

* * * * *